US008517487B2

(12) United States Patent
Chandler

(10) Patent No.: US 8,517,487 B2
(45) Date of Patent: Aug. 27, 2013

(54) SYSTEMS AND METHODS FOR DIELECTRIC HEATING OF INK IN INKJET PRINTERS

(75) Inventor: Michael O Chandler, Corona Del Mar, CA (US)

(73) Assignee: Conexant Systems, Inc., Irvine, CA (US)

( * ) Notice: Subject to any disclaimer, the term of this patent is extended or adjusted under 35 U.S.C. 154(b) by 380 days.

(21) Appl. No.: 12/820,932

(22) Filed: Jun. 22, 2010

(65) Prior Publication Data

US 2011/0310144 A1 Dec. 22, 2011

(51) Int. Cl.
*B41J 29/38* (2006.01)

(52) U.S. Cl.
USPC ..... 347/9; 347/44; 347/55

(58) Field of Classification Search
USPC ..... 347/9–10, 44, 47, 54–56, 84–86
See application file for complete search history.

(56) References Cited

U.S. PATENT DOCUMENTS 4,419,673 A * 12/1983 Ebi et al. ..... 347/48
4,538,163 A * 8/1985 Sheridon ..... 347/125
4,717,926 A * 1/1988 Hotomi ..... 347/55
4,962,723 A * 10/1990 Hotomi ..... 347/55
5,130,722 A * 7/1992 Onishi et al. ..... 347/54
5,144,340 A * 9/1992 Hotomi et al. ..... 347/55
7,458,661 B2 * 12/2008 Kim et al. ..... 347/47
7,475,965 B2 1/2009 Silverbrook
7,618,120 B2 11/2009 Fang et al.

OTHER PUBLICATIONS

Turlajs, D., et al; Initial Stage of Vapor Bubble Growth in Superheated Liquids; International Journal of Systems Applications, Engineering & Development; vol. 1, Issue 1, pp. 9-11, Jan. 1, 2007.
Lindemann, T., et al; Three Dimensional CFD-Simulation of a Thermal Bubble Jet Printhead; NSTI-Nanotech 2004, ISBN 0-9728422-8-4, vol. 2, pp. 227-230, Jan. 1, 2004.
Meinhart Carl D., et al.; The Flow Storage Inside a Microfabricated Injet Printhead; Journal of Microelectromechanical Systems, vol. 9, No. 1, pp. 67-75, Mar. 2000.
Shah, Jayna J. et al.; Microwave Dielectric Heating of Fluids in an Integrated Microfluidic Device; Journal of MicroMechanics and Microengineering; 17, 2224-2230, Jan. 1, 2007.
Furlani, Edward P. et al; Thermally Induced Marangoni Instability of Liquid Microjets with Application to Continuous Inkjet Printing; Nanotech Conference and Trade Show, Jan. 1, 2006, 4 pages.

(Continued)

*Primary Examiner* — Juanita D Jackson
(74) *Attorney, Agent, or Firm* — Jackson Walker L.L.P.; Christopher J. Rourk

(57) ABSTRACT

Dielectric heating is used to cause explosive nucleation of ink in an ink reservoir to expel a drop of ink from an inkjet print head. Conductive plates generate an alternating electric field at microwave frequencies across an ink reservoir causing the ink to heat. Since the ink is heated without heating the conductive plates, less heat dissipation of the inkjet print head is necessary.

20 Claims, 5 Drawing Sheets

(56) References Cited

OTHER PUBLICATIONS

Micro Microwave Oven for Lab-On-A-Chip Devices Developed; National Institute of Standards and Technology; Nov. 12, 2007, 2 pages.

Photograph of the NIST Micro Microwave Oven, NISTmicropic.jpg, Mar. 1, 2011.

Leung, Pak Kin, et al.; Comparative Study of Size Effect of Micro Bubble Dynamics by Sub-100 Microsecond and Millisecond Pulse Heating; Conference on Nano/Micro Engineered and Molecular Systems, Jan. 18-21, 2006, Zhuhai, China, pp. 523-527.

Lin, Liwei; Microscale Thermal Bubble Formation: Thermophysical Phenomena and Applications; Microscale Thermophysical Engineering, 2: 71-85, Jan. 1, 1998.

Zhang, Lian, et al.; Enhanced Nucleate Boiling in Microchannels; IEEE Xplore, Jan. 1, 2002.

Okuyama, Kunito, et al.; Allowable Repetition Frequency of Pulse Heating in Microactuators Using Rapid Boiling; JSME International Journal, Series B, vol. 46, No. 3, Jan. 1, 2003, pp. 399-407.

Wijshoff, Herman; Application Note: Modeling the Drop Formation Process in Inkjet Printheads; FLOW-D2 News; Mar. 1, 2007, 3 pages.

* cited by examiner

SYSTEMS AND METHODS FOR DIELECTRIC HEATING OF INK IN INKJET PRINTERS

BACKGROUND OF THE INVENTION

1. Field of the Invention

The present invention relates generally to inkjet printing and specifically to the use of dielectric heating within an inkjet nozzle to expel a drop of ink.

2. Related Art

Inkjet printers work by squirting ink onto paper. They are non-impact printers in the sense that there is no physical contact between the paper and the print head to render images on a sheet of paper (or other medium). Unlike other non-impact printers, such as laser printers, inkjet printers use aqueous ink to create the images on the paper.

A typical inkjet print head comprises a plurality of nozzles which can simultaneously impart ink from the nozzle to the paper. Presently, the two major types of nozzles in widespread use are thermal nozzles and piezoelectric nozzles.

The performance of the thermal nozzle is constrained by the ability of the nozzle to dissipate heat from a heating element contained in the nozzle to heat the ink. Because the heating element is electrically and thermally coupled to the substrate controlling the nozzle, heat must be dissipated from the substrate. Overheating can lead to damage to the print head and controlling circuitry. The issue of heat dissipation limits the speed of printing, the density of nozzles and the number of nozzles that can simultaneously fire. Because not all nozzles can fire simultaneously, multiple passes must be made when high density color is required such as in photo quality printing.

Piezoelectric nozzles require complex waveforms to "wiggle" drops out of the nozzle requiring greater complexity and size to the print head control circuits. Furthermore, most piezoelectric crystals included in piezoelectric nozzles operate at higher voltages than standard control circuitry.

SUMMARY OF INVENTION

A novel inkjet delivery system, method and device are disclosed. A print head system comprises an ink reservoir, a nozzle and conductive plates. An alternating current signal at microwave frequencies produces an electric field between the conductive plates and across the ink reservoir. This causes explosive nucleation which causes a bubble in the ink to form which expels a drop of ink from the nozzle. In one embodiment, the conductive plates are thermally insulated from the ink reservoir. In another embodiment, electrolytes are added to the ink to improve the dielectric heating in the ink. In another embodiment, the walls of the ink reservoir can comprise texturing or projections to roughen the surface lowering the energy needed for nucleation.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

A detailed description of embodiments of the present invention is presented below. While the disclosure will be described in connection with these drawings, there is no intent to limit it to the embodiment or embodiments disclosed herein. On the contrary, the intent is to cover all alternatives, modifications and equivalents included within the spirit and scope of the disclosure.

Figure 1:
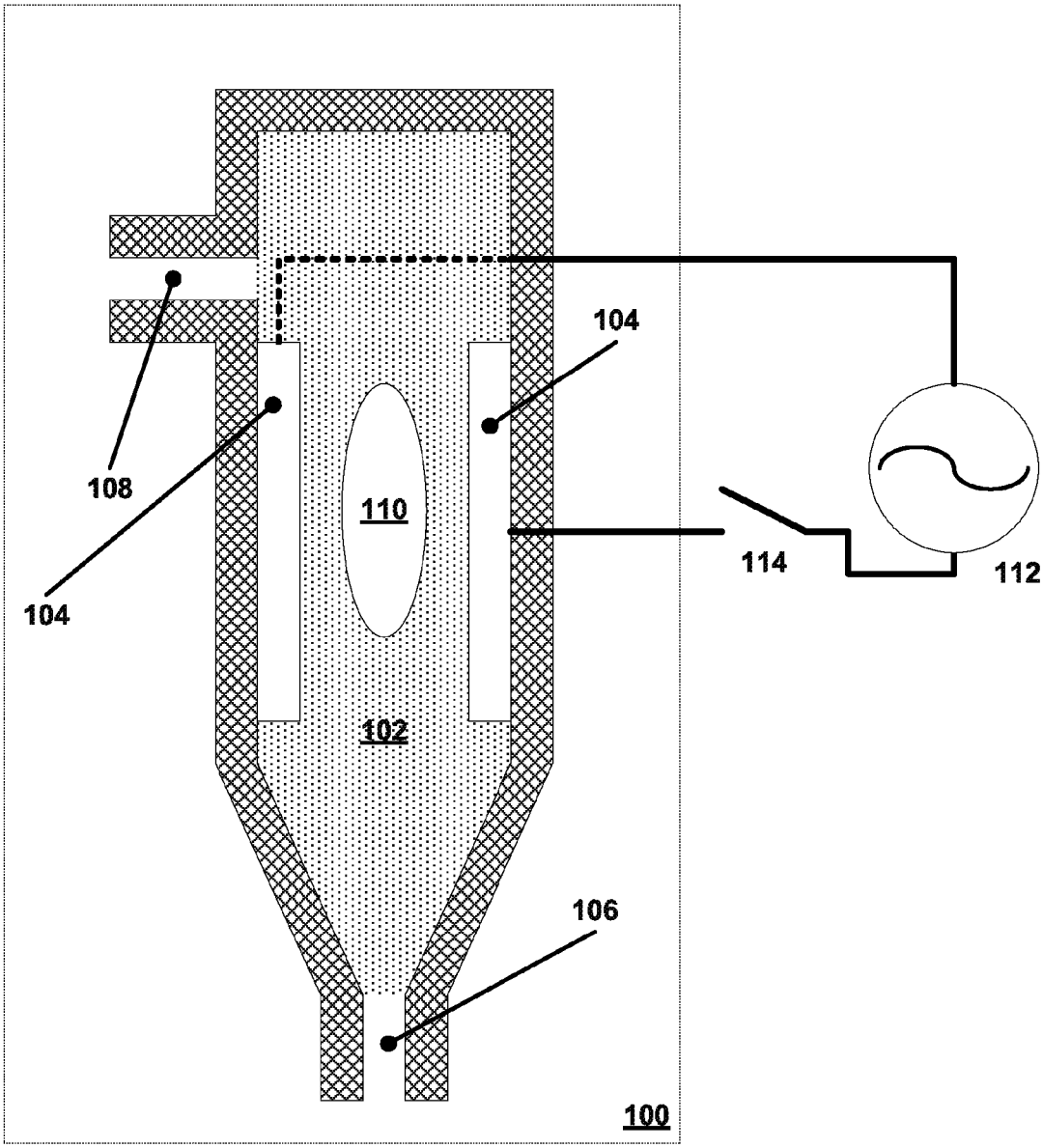
FIG. 1 illustrates a basic dielectric ink nozzle.

FIG. 1 illustrates a basic dielectric ink nozzle. Dielectric nozzle 100 comprises ink reservoir 102, conductive plates 104, nozzle 106, and ink cartridge intake 108. An alternating current is applied to conductive plates 104, and depending on the frequency of the current, the water in the ink will heat. Frequencies between 1 GHz and 20 GHz are known to cause water to heat. This can be supplied by a signal generator such as signal generator 112 and activated by switch 114. When sufficient heating occurs, the fast vaporization known as explosive nucleation takes place causing bubble 110 to form. The expansion of the bubble forces out a drop of ink. After the ink is expelled, the current is turned off and the bubble collapses, the vacuum created sucks in ink from an ink cartridge through ink cartridge intake 108. Because opening for nozzle 106 is generally much smaller than ink cartridge intake 108, the surface tension of the ink prevents air from being sucked into ink reservoir 102 when the bubble collapses.

It should be noted that the conductive plates are shown as parallel conductive plates: other configurations can be used. However, parallel conductive plates are among the simplest. Additionally, the plates are shown here as inside the wall of the ink reservoir, but can easily be outside as shown later. The size of the dielectric nozzle can dictate the spacing of the plates. For example, a typical thermal inkjet nozzle has a reservoir on the order of 10 microns. Therefore, the conductive plates may be placed 10 microns apart.

The circuitry to drive an alternating current between 1 GHz and 20 GHz can be found in various modern wireless technologies. For example, 802.11 WiFi standards use 2.4 GHz and 5 GHz for transmissions. In fact, there are numerous ways to generate a signal in the 1 GHz to 20 GHz range, including circuitry comprising complementary metal-oxide-semiconductor (CMOS) technology. Furthermore, since the purpose of the signal generator is to heat the ink, the frequency supplied to the conductive plates does not need to be of a specific frequency as they would for a signal used for communications. Hence some design constraints, such as the precise frequency of operation placed on the signal generator, can be relaxed. However, regulatory considerations may dictate the frequency selection. For example, microwave ovens operate at 2.45 GHz because the Federal Communications Commission (FCC) has allocated that frequency for microwave ovens to prevent interference with other communications. In this situation, the choice of frequencies may be limited for regulatory concerns but not for operational considerations.

The heating process works because of the polar nature of the water in the ink. Therefore, the energy transfer to the water can be improved by ionizing the water further. This can be accomplished by the addition of electrolytes, such as a salt, to the water. A small amount of electrolyte can increase the ionization in the water but without any effect on the quality of the image printed. The increase in ionization leads to more efficient transfer of energy from the alternating current to the water.

Figure 2:
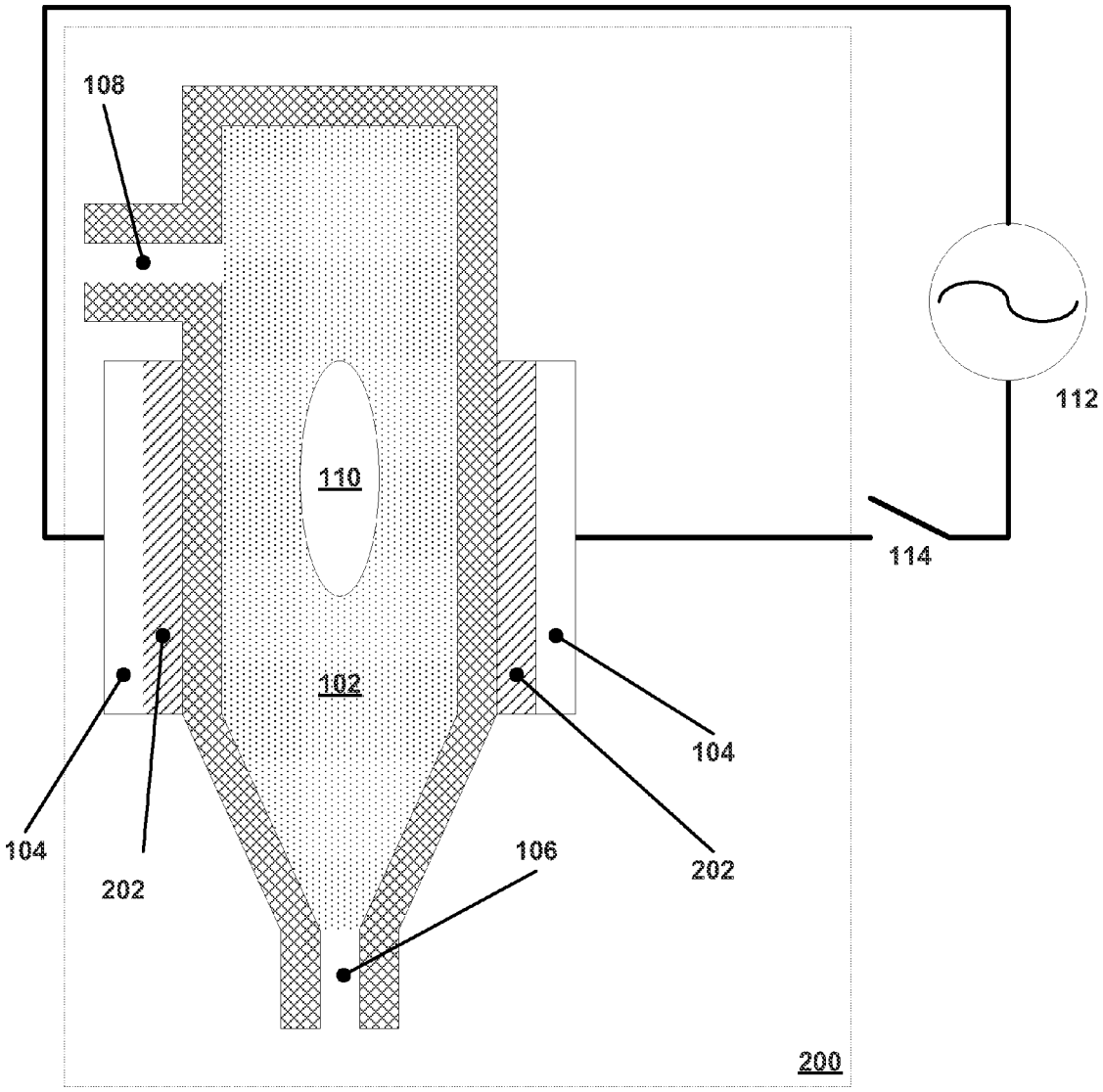
FIG. 2 shows an alternative embodiment for a dielectric nozzle.

FIG. 2 shows an alternative embodiment for a dielectric nozzle. Like dielectric nozzle 100, dielectric nozzle 200 comprises ink reservoir 102, conductive plates 104, nozzle 106, and ink cartridge intake 108. In addition, dielectric nozzle 200 further comprises insulators 202 between conductive plates 104 and ink reservoir 102. Because the dielectric nozzle uses dielectric heating to vaporize ink rather than thermal conduction, conductive plates 104 do not have to be in physical contact with ink reservoir 102. This offers two benefits. First the conductive plates can be thermally insulated from the ink, so the heat generated from vaporizing the ink is not significantly conducted to back to the conductive plates and to the driving circuitry. Second, the conductive plates are not exposed to the ink where electrochemical processes could ultimately corrode the conductive plates.

Nucleation is known to take place at lower energies when containers have rough edges rather than a smooth container. As a result, the addition of texturing or projections can lower the energy and temperature required for a bubble to form.

Figure 3:
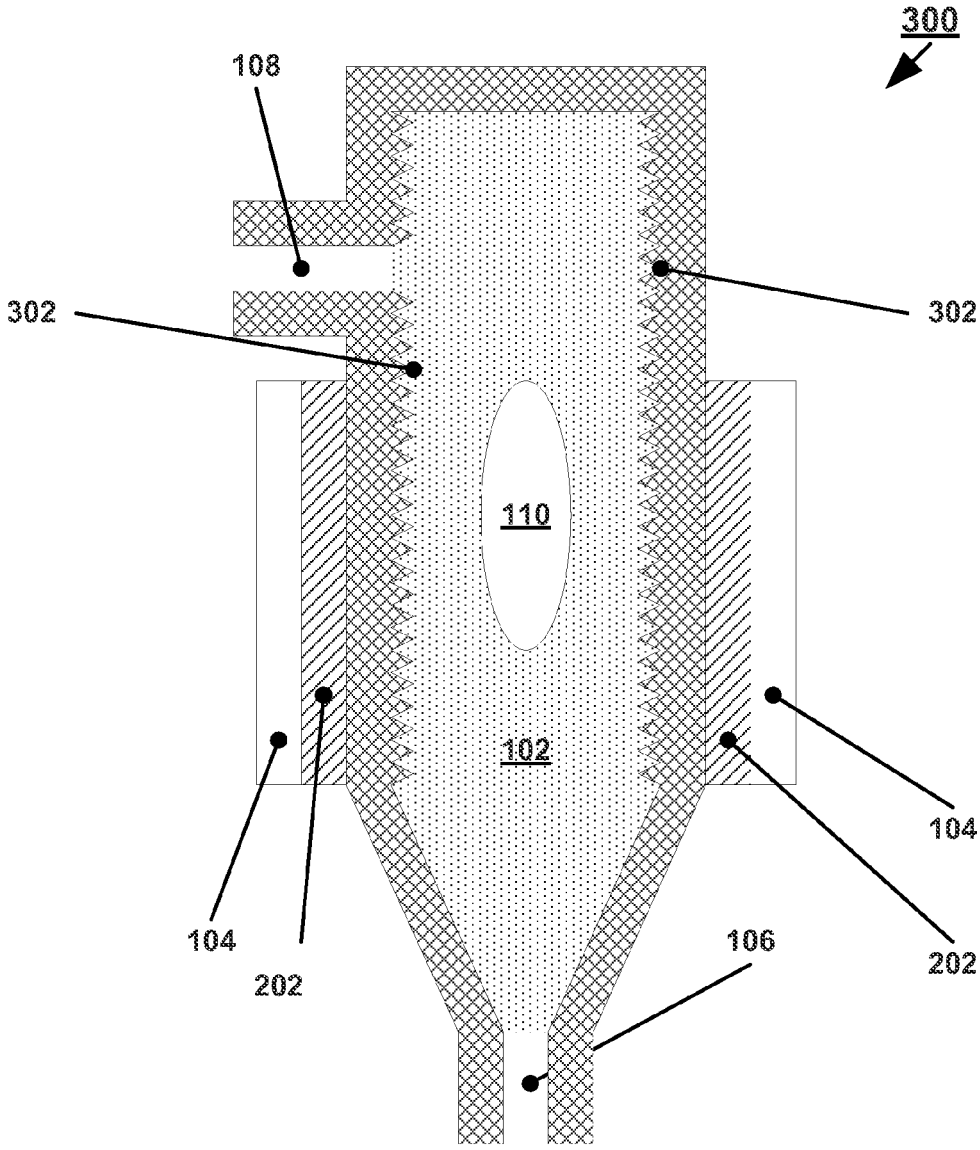
FIG. 3 shows embodiment of a dielectric nozzle having textured reservoir walls.

FIG. 3 shows embodiment of a dielectric nozzle having textured reservoir walls. Dielectric nozzle 300 is similar to dielectric nozzles 100 and 200. However, dielectric nozzle 300 further comprises texturing 302 on the walls of ink reservoir 102. The texturing can be a regular pattern such as the sawtooth pattern shown in the diagram or a random pattern. Texturing supplies a roughness which can reduce the temperature and energy required to get a bubble to form.

Figure 4:
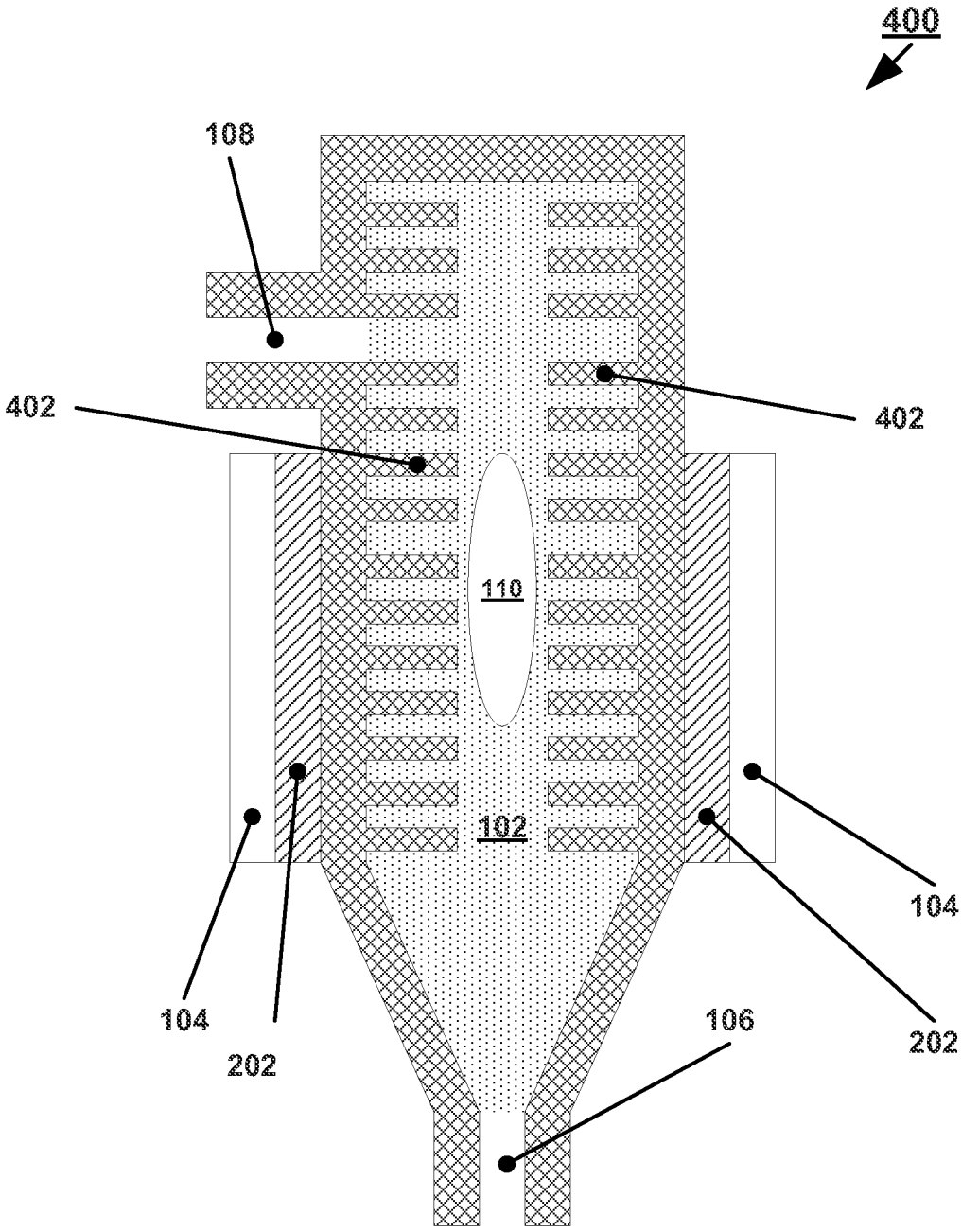
FIG. 4 shows an embodiment of a dielectric nozzle using projections to "roughen" the walls of the ink reservoir.

FIG. 4 shows an embodiment of a dielectric nozzle using projections to "roughen" the walls of the ink reservoir. Dielectric nozzle 400 is similar to dielectric nozzles 100, 200 and 300. Projections 402 are added to the walls of ink reservoir 102 to provide "roughness" to the ink reservoir. Any type of projection can be added. For example, in this figure, fins are added to the walls of the ink reservoir.

Figure 5:
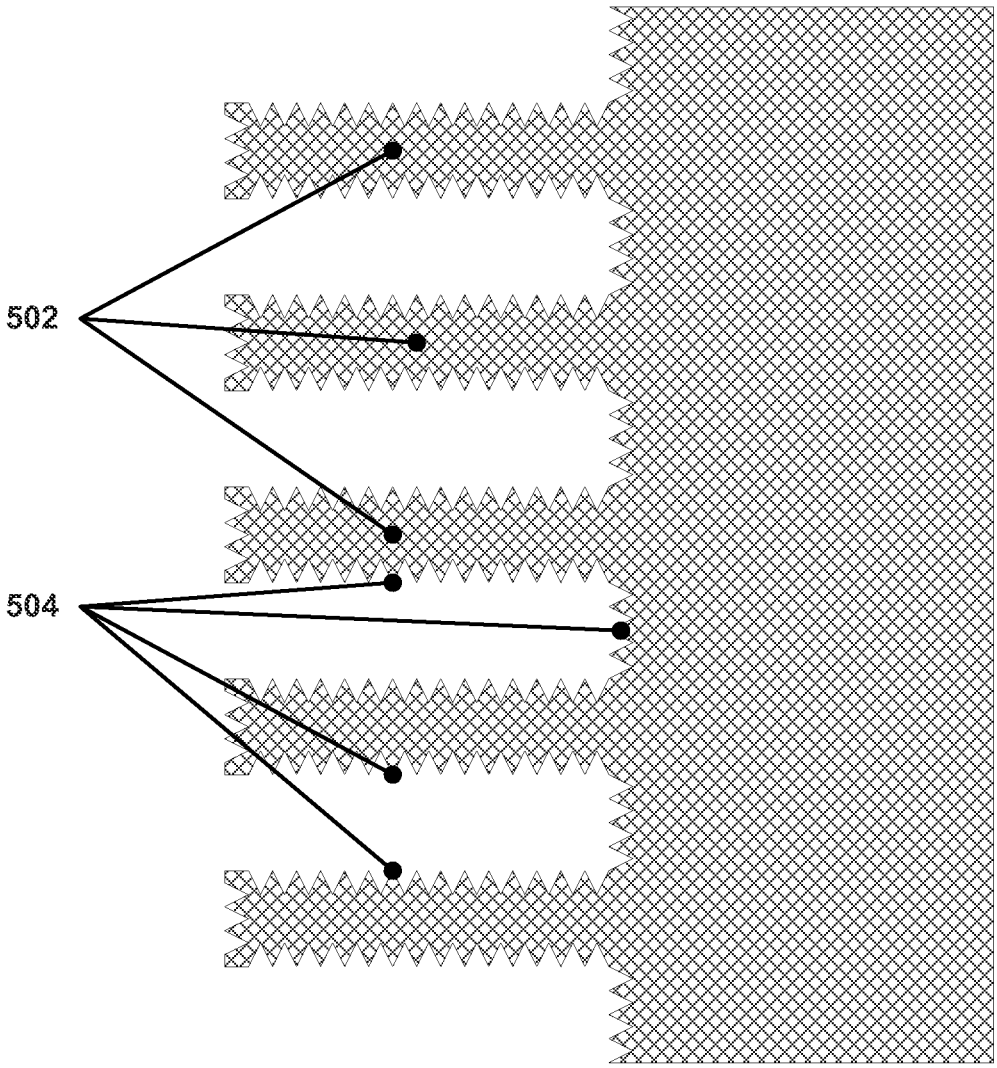
FIG. 5 is a magnified view of a portion of the walls of the ink reservoir in another embodiment where the ink reservoir has both projections and texturing.

Furthermore, texturing can be applied to the walls of the ink reservoir even with projections. FIG. 5 is a magnified view of a portion of the walls of ink reservoir 102 in another embodiment where the ink reservoir has both projections and texturing. Texturing 504 is added on top of projections 502. The use of projections and/or texturing can significantly reduce the energy needed to operate a dielectric heated inkjet nozzle.

An array of dielectric nozzles described above can be used in a printer head in an inkjet printer. Because, the amount of heat to be dissipated is less than that of a thermal nozzle, more nozzles can eject ink simultaneously resulting in fewer passes of the printer head for applications like photo quality printing.

Furthermore, inkjet printing can be used for other applications, such as fabrication. For example, inkjet printing can be used in fabricating electrical or optical device, particularly for deposing organic materials such as organic dyes. In addition, inkjet printing technology has been used to create organic transistors, conducting polymers, structural polymers, ceramics, nanoparticles, metals, nucleic acids, and protein arrays. Inkjet printing has even been used to deposit DNA onto membranes. Other researchers have used inkjet printing to print antigens onto polycarbonate materials for immunoassay. Still others have used inkjet printing to fabricate small biosensors. One researcher has even used inkjet printing to "print" human liver cells onto a buffer.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed:

1. An inkjet print head comprising:
a nozzle;
an ink reservoir;
a first conductor; and
a second conductor;
wherein the first conductor and second conductor apply an electric field across the ink reservoir that alternates at a microwave frequency, and wherein a first thermal insulator isolates the first conductor from the ink reservoir and a second insulator isolates the second conductor from the ink reservoir.

2. The inkjet print head of claim 1 wherein the first conductor and the second conductor is coupled to a signal generator which generates a signal at the microwave frequency and having a signal strength sufficient to cause explosive nucleation of ink contained within the ink reservoir.

3. The inkjet print head of claim 1 wherein the microwave frequency is between 1 GHz and 20 GHz.

4. The inkjet print head of claim 3 wherein the microwave frequency is essentially 2.45 GHz.

5. The inkjet print head of claim 1 wherein the ink reservoir contains an aqueous ink with added electrolytes.

6. The inkjet print head of claim 1 wherein the ink reservoir comprises walls having texturing.

7. The inkjet print head of claim 1 wherein the ink reservoir comprises walls and projections attached to the walls.

8. An inkjet printer comprising:
an ink cartridge;
an inkjet print head comprising:
a nozzle;
an ink reservoir;
a first conductor; and
a second conductor;
wherein the first conductor and second conductor apply an electric field across the ink reservoir that alternates at a microwave frequency and the ink reservoir draws ink from the ink cartridge, and wherein a first thermal insulator isolates the first conductor from the ink reservoir and a second insulator isolates the second conductor from the ink reservoir.

9. The inkjet printer of claim 8 wherein the first conductor and the second conductor is coupled to a signal generator which generates a signal at the microwave frequency.

10. The inkjet printer of claim 8 wherein the microwave frequency is between 1 GHz and 20 GHz.

11. The inkjet printer of claim 10 wherein the microwave frequency is essentially 2.45 GHz.

12. The inkjet printer of claim 8 wherein the ink reservoir contains an aqueous ink with added electrolytes.

13. The inkjet printer of claim 8 wherein the ink reservoir comprises walls having texturing.

14. The inkjet printer of claim 8 wherein the ink reservoir comprises walls and projections attached to the walls.

15. A method of expelling ink from an ink reservoir comprising:

causing explosive nucleation in ink contained in the ink reservoir, by applying an alternating electromagnetic field having a microwave frequency across the ink in the ink reservoir from electrodes that are insulated from the ink reservoir.

16. The method of claim 15, wherein the ink contains electrolytes.

17. The method of claim 15, wherein the microwave frequency is between 1 GHz and 20 GHz.

18. The method of claim 15, wherein the microwave frequency is essentially 2.45 GHz.

19. The method of claim 15 further comprising turning the alternating electromagnetic field on and off.

20. The method of claim 15 wherein applying the alternating electromagnetic field comprises applying the alternating electromagnetic field at a field strength sufficient to cause explosive nucleation of ink contained within the ink reservoir.

* * * * *